United States Patent [19]

Landolt et al.

[11] 4,257,201

[45] Mar. 24, 1981

[54] SELF-CENTERING TELESCOPING BEAMS

[75] Inventors: Christoph A. Landolt, Zurich, Switzerland; LeRoy G. Krupke, Cottage Grove, Minn.

[73] Assignee: American Hoist & Derrick Company, St. Paul, Minn.

[21] Appl. No.: 31,502

[22] Filed: Apr. 19, 1979

[51] Int. Cl.[3] ..... E04H 12/34

[52] U.S. Cl. ..... 52/118; 212/230; 212/268; 52/632

[58] Field of Search ..... 52/110, 115, 118, 632; 212/55, 144, 267, 268, 269

[56] References Cited

U.S. PATENT DOCUMENTS

| | | | |
|---|---|---|---|
| 3,368,696 | 2/1968 | Johnston et al. | 212/268 |
| 3,481,490 | 12/1969 | Eiler | 212/55 |
| 3,620,579 | 11/1971 | Brown et al. | 212/55 |
| 3,708,937 | 1/1973 | Sterner | 52/118 |
| 3,719,403 | 3/1973 | Sung | 308/3 R |
| 3,719,404 | 3/1973 | Sterner | 212/55 |
| 3,748,807 | 7/1973 | Sterner | 52/632 |
| 3,837,502 | 9/1974 | Hornagold | 212/55 |
| 3,907,385 | 9/1975 | Bartenstein | 308/6 |
| 3,913,659 | 10/1975 | Chatourel | 308/3 |
| 3,985,234 | 10/1976 | Jouffray | 52/118 |
| 4,016,688 | 4/1977 | Tiffin et al. | 52/115 |
| 4,045,936 | 9/1977 | Sterner | 52/632 |
| 4,171,598 | 10/1979 | Holmes | 52/118 |

FOREIGN PATENT DOCUMENTS 1495042 12/1977 United Kingdom .

*Primary Examiner*—James L. Ridgill, Jr.
*Attorney, Agent, or Firm*—Kinney, Lange, Braddock, Westman & Fairbairn

[57] ABSTRACT

A hydraulically extensible crane boom includes a plurality of mutually innernested, telescopically associated inward and outward boom sections. Each section is made up of a pair of longitudinally extending, parallel, spaced apart upper structural shapes of substantial mass and strength, a relatively light top web integral with and extending between the upper structural shapes, a pair of longitudinally extending, mutually parallel, spaced apart lower structural shapes of substantial strength and mass, a relatively light bottom web integral with and extending between the lower structural members, and a pair of relatively light side webs each connected between one upper and one lower structural member. The distance between the lower pair of structural members is less than the distance between the upper pair of structural members. Each one of each pair of upper structural members of each inward boom section is provided with an upwardly converging inner plane surface; and each outward boom section has a pair of rearwardly mounted slide pad assemblies situated to position their slide pads in sliding relationship with respect to such converging surfaces. Each one of each pair of upper structural members of each outer boom section is provided with an outwardly diverging outer plane surface; and each inward boom section has a forwardly mounted slide pad assembly situated to bring its slide pad in sliding supporting relationship with respect to this outwardly diverging surface. Means is provided for mounting the innermost of the inward boom sections with respect to a base and for handling a load at the boom point of an outermost of the outward boom sections. Means is also provided for moving the boom sections longitudinally with respect to each other.

7 Claims, 6 Drawing Figures

SELF-CENTERING TELESCOPING BEAMS

BACKGROUND OF THE INVENTION

This invention has relation to telescoping beams used as elements of hydraulic extensible crane booms, for example. Such crane booms include a plurality of hollow, telescopic boom sections or beams powered to increase and decrease the boom length by sliding with respect to each other.

In telescopic crane booms presently of commerce, forwardly mounted wear pads or slide pads are provided inside of the forward end of each inward boom section to be in supporting bearing relationship with respect to the underside of its associated outward boom section. Rearwardly mounted slide pads or wear pads are provided outside of the rear end of each outward boom section to be in bearing relationship with respect to the inner top surface of the inward boom section. These pads are provided to support the vertical reactive forces of the weight of the outward boom sections and the load being handled by the boom and also to provide sufficient surface to distribute the load in the boom sections or beams. Further, the slide pads accommodate the wear which accompanies the sliding action by being softer than the adjacent beam surface on which they slide. In such telescopic crane booms, means must also be provided to maintain lateral alignment of the boom section or beams with respect to each other. This has usually been accomplished by providing side wear pads mounted on shims, which can, with difficulty, be adjusted to compensate for wear.

Because of the fact that deflection of the boom sections or beams occurs under load, and because the pad reaction forces are very high, the wear pad or sliding pad base and the sliding boom section plate are not always parallel to each other; and as the beams slide with respect to each other and as the loading changes, this relationship of the wear pad base to the sliding boom section plate is a dynamic relationship and can change as the beams slide with respect to each other. This creates a problem in distributing the forces between adjoining boom sections or beams so as to eliminate edge loading of the wear pads. Also, because of manufacturing tolerances, the two innernested sections will not always be exactly parallel to each other. Therefore, a wear pad which can pivot with respect to the boom section to which it is mounted to conform to the surface area of the boom section on which it is sliding should be provided. Such a structure is disclosed in our co-pending application Ser. No. 948,773, filed Oct. 5, 1978 for SELF-ALIGNING FLEXIBLE SLIDE PADS FOR TELESCOPING BEAMS, now abandoned: and the complete disclosure of that application is incorporated herein by this reference to it.

Several other inherent problems associated with prior art telescoping beams such as telescopic crane booms, for example, include inefficient use of the structural material therein causing the highest stresses to be in the corners, tending to cause compressive buckling of the bottom plate, tending to cause local compressive buckling of the side plates in the front pad area, and causing problems in the lateral alignment of the sections with respect to each other.

The crane industry has attempted to solve some of these problems, with not entirely satisfactory results.

Compressive buckling of the side plate is overcome by providing stiffeners in the zone of side plate compression. Because the sections are telescopic with respect to each other, however, these stiffeners are required over a great length of the section in question, adding substantially to the weight of the boom section or beam, and thus reducing the amount of payload that can be handled by the boom.

Bent top and bottom plates have been provided to make the boom sections self-aligning, but extra care has to be taken in such structures to assure the stability of the boom against twisting and other lateral instability.

At an early stage of the development of this invention, a preliminary search was made and the following patents were located:

- U.S. Pat. No. 3,708,937 granted to Sterner in January of 1973;
- U.S. Pat. No. 3,719,404 granted to Sterner in March of 1973;
- U.S. Pat. No. 3,748,807 granted to Sterner in July of 1973;
- U.S. Pat. No. 3,907,385 granted to Bartenstein in September of 1975; and
- U.S. Pat. No. 3,913,659 granted to Chatourel in October of 1975.

U.S. Pat. No. 3,708,937 to Sterner shows an inverted trapezoid cross section boom with vertical acting lower wear pads 34,34' and 34'', vertically acting rear wear pads 39, front lateral guides or pads 63,63' and 63'' and rear lateral guides or pads 64,64' and 64''.

U.S. Pat. No. 3,719,404 also to Sterner discloses swiveled wear pads 27 which are designed to adjust themselves on spherical seats to maintain a full surface contact with the sliding boom sections with which they are in contact; but which do not have any substantial ability to absorb lateral loads.

U.S. Pat. No. 3,907,385 to Bartenstein and U.S. Pat. No. 3,913,659 to Chatourel are not in the direct art, but do show broadly canted self-centering slide bearings for machinery.

U.S. Pat. No. 3,748,807 to Sterner shows adjustable lateral guides or side wear plates including forward lateral guide pads 22 positionable under the control of adjusting screws 31 and rear lateral guide pads 34 under the control of adjusting set screws 38 for controlling the lateral positioning of the beams with respect to each other while slide pads 18 handle the vertical forces on the beams.

Applicants and those in privity with them know of no closer prior art than set out above or referred to in their above identified co-pending application; and they know of no prior art which anticipates the claims made in this application.

BRIEF SUMMARY OF THE INVENTION

A telescopic boom assembly for use as a hydraulic extensible crane boom, for example, includes a plurality of mutually innernested, telescopically associated inward and outward boom sections, each inward boom section being situated in surrounding, adjacent relationship to an outward boom section. Each boom section is made up of a pair of longitudinally extending, parallel, spaced apart upper structural members of shapes of substantial mass and strength, a relatively light top web or plate integral with and extending between said upper structural members or shapes, a pair of longitudinally extending, mutually parallel, spaced apart lower structural members or shapes of substantial strength and mass, a relatively light bottom web or plate integral with and extending between said lower structural members, and a pair of relatively light, generally upright, side webs or plates each integral with a separate one of each of said upper and lower structural members or shapes. Each of the upper structural members has a uniform cross sectional shape throughout the length of the portion thereof that is or can be innernested with its adjacent boom sections.

Means is provided for moving the boom sections longitudinally with respect to each other. In the form of the invention as shown, an inward end of the boom assembly is mounted to a base and means for supporting a load is provided at the outward end of the boom assembly.

Forwardly mounted slide assemblies including slide pads are provided on each inward boom section and rearwardly mounted slide assemblies are provided on each outward boom section, these slide assemblies being in position to slidingly support immediately adjacent boom sections.

In the form of the invention as shown, each upper structural member or shape of an inward boom section is provided with an inwardly facing, diagonally situated plane bearing surface, converging upwardly with respect to its oppositely positioned counterpart; and the rearwardly mounted slide assemblies of each outward boom section are positioned to bring a wear pad or slide pad into sliding, load bearing relationship with respect to this boom section bearing surface of its adjacent inward boom section.

Also in the form of the invention as shown, each upper structural member or shape of each outward boom section is provided with an outer, diagonally situated plane bearing surface, diverging upwardly with respect to its oppositely positioned counterpart; and the forwardly mounted slide assemblies of each inward boom section are positioned to bring a wear pad or slide pad into sliding, load bearing relationship with respect to this boom section bearing surface of its adjacent outward boom section.

The forwardly and rearwardly mounted slide pad assemblies can take a number of different forms and can be mounted in a number of different places to obtain at least some of the benefits of the structure of the invention. As shown, however, these slide pad assemblies include a container or pot fixedly mounted with respect to one of the boom section, this pot having a rectilinear slide pad receptacle or opening therein, a free flowing elastic material situated in a lower portion of the pot to lie in spaced relation below the top edge of the pot walls, and a flexible wear pad of shape to fit snugly into the pot to have contact with all of the interior wall surface of the pot receptacle, and to extend above the top edge of the pot walls to position the slide pad or wear pad in contacting, sliding, load bearing relationship with respect to a plane bearing surface of an adjacent boom section.

IN THE DRAWINGS

FIG. 1 is a side elevational view of a wheel-mounted crane with the telescoping beams of the invention mounted thereon, these beams being shown both in full lines in a fully retracted, stored position and partially in broken lines and partially in full lines in a load-handling, partially extended, operative position;

FIG. 6 is a further enlarged fragmentary sectional view taken on the line 6—6 in FIG. 5.

DESCRIPTION OF PREFERRED EMBODIMENT

Figure 7:
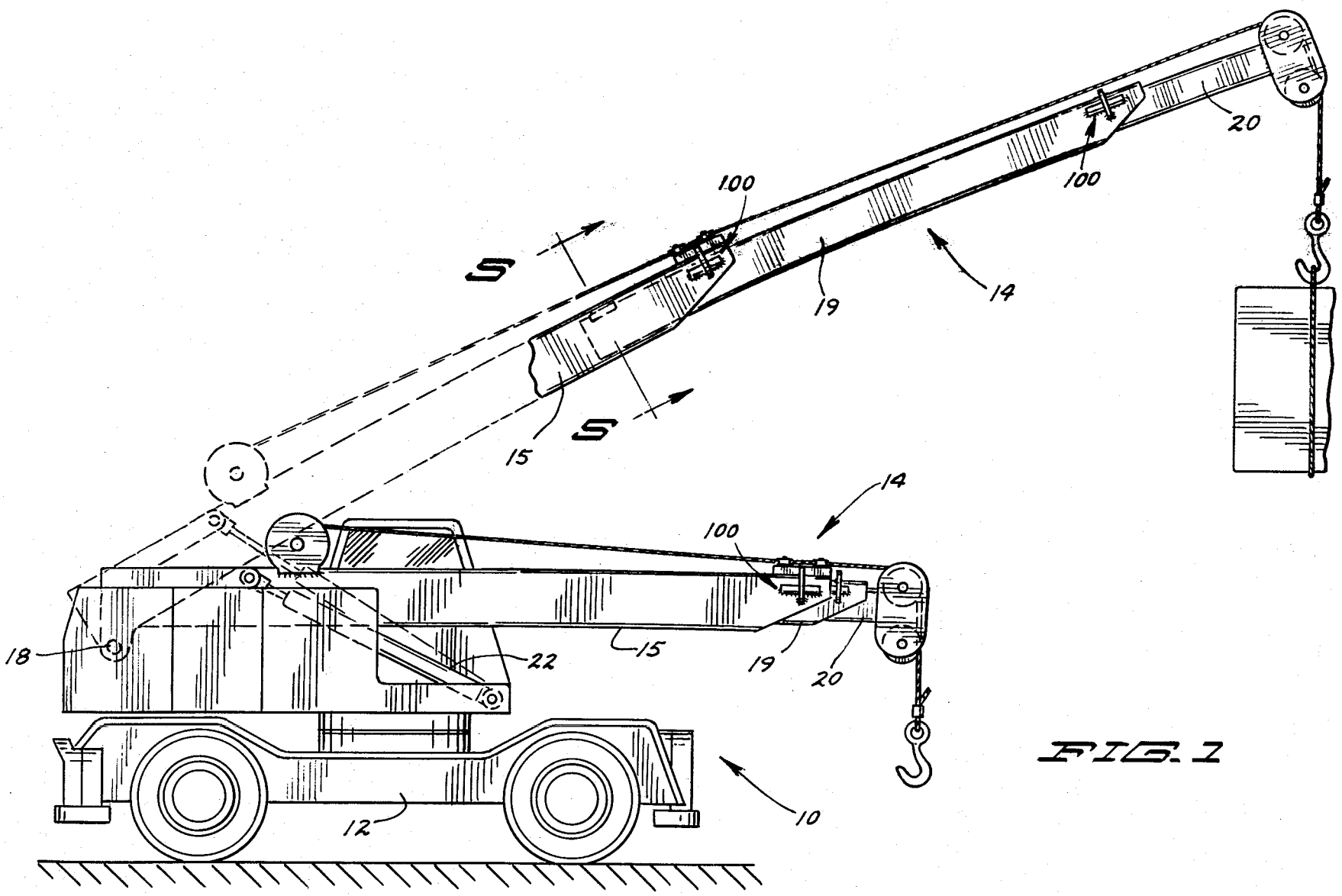
Figure 2:
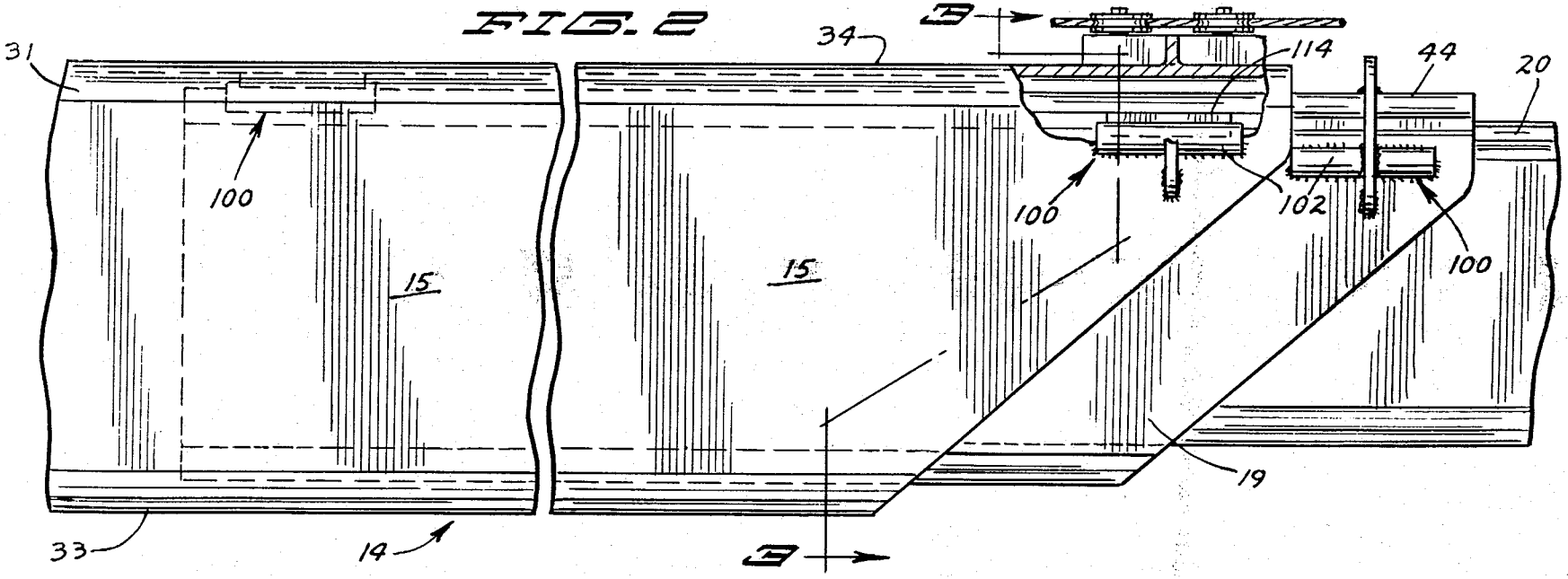
FIG. 2 is an enlarged fragmentary view of a portion of the telescoping beams of FIG. 1 in their retracted, stored position with parts in section and parts broken away.

A wheel-mounted hydraulic crane 10 includes a truck body 12 and a hydraulically extensible boom 14 which includes an inward or base boom section or beam 15 pivotally mounted as at 18 to the truck body 12, and being situated in surrounding relationship to an intermediate boom section or beam 19. Intermediate beam 19 is situated in surrounding relationship to an outward or boom point section or beam 20. Hydraulic means 22 of any usual or preferred construction is provided to raise and lower the boom, and hydraulic means 24 inside of the boom of any usual or preferred construction is provided to telescopically extend and retract the outward section or beam 20 and the intermediate section or beam 19 with respect to the inward or base boom section 15.

Each of the boom sections or beams 15, 19 and 20 are made up of structural members or shapes in the four corners joined together by thin top, bottom and side plates or webs welded between them. These structural shapes may be hot rolled or extruded and each consists of a large area shaped in such a way as to facilitate the slide pad arrangements. As shown, in each beam, the side plates are symmetrical, but the bottom plates are narrower than the top plates to provide a tapered construction.

The inward or base boom section or beam 15 includes upper structural members or shapes 30 and 31 which are mirror images of each other in transverse cross section, lower structural members or shapes 32 and 33 which are also mirror images of each other, a relatively thin top plate or web 34 welded between upper shapes 30 and 31, a relatively thin bottom or web 35 welded between lower shapes 32 and 33, and relatively thin side webs or plates 36 and 37 welded between upper shape 30 and lower shape 32 and between upper shape 31 and lower shape 33, respectively.

The intermediate boom section or beam 19 includes mirror image upper structural members or shapes 40 and 41, mirror image lower structural shapes or members 42 and 43, relatively thin top web or plate 44 welded between shapes 40 and 41, relatively thin bottom plate or web 45 welded between shapes 42 and 43, and relatively thin side webs or plates 46 and 47 welded between shapes 40 and 42 and between shapes 41 and 43 respectively.

Outward or boom point section or beam 20 includes mirror image upper structural members or shapes 50 and 51, mirror image lower structural shapes or members 52 and 53, relatively thin top web or plate 54 welded between shapes 50 and 51, relatively thin bottom plate or web 55 welded between lower shapes 52 and 53, and side webs or plates 56 and 57 welded respectively between upper shape 50 and lower shape 52 and between upper shape 51 and lower shape 53.

One of a pair of forwardly mounted slide pad assemblies situated in a forward portion of each inward boom section or beam is positioned to be in sliding, supporting engagement with respect to one of the upper structural shapes of its immediately adjacent outward boom section or beam; and one of a pair of rearwardly mounted slide pad assemblies situated in a rear portion of each outward boom section or beam is positioned to be in sliding supporting contact with one of the upper structural shapes of its immediately adjacent outward boom section or beam, in the form of the invention as shown.

Thus forwardly mounted slide pad assemblies 60 and 61 are mounted, as by welding, in side plates 36 and 37 of the inward or base boom section or beam 15 to be in sliding relationship to outer, diagonally situated, outwardly diverging, plane bearing surfaces 62 and 63 of upper structural shapes 40 and 41 of the intermediate boom section 19, respectively.

Similarly, forwardly mounted slide pad assemblies 70 and 71 are mounted, as by welding, in side plates 46 and 47 of the intermediate boom section 19 to slide on diagonally situated plane bearing surfaces 72 and 73 of the structural shapes 50 and 51 of the outer boom point section 20.

Rearwardly mounted slide pad assemblies 80 and 81 are supported as by welding in cavities provided in the upper structural shapes 50 and 51 of the outward or boom point section or beam 20 to be in sliding relationship to inwardly facing, diagonally situated, upwardly converging, plane bearing surfaces 82 and 83 of upper structural shapes 40 and 41 respectively of the intermediate boom section or beam 19.

Similarly, rearwardly mounted slide pad assemblies 90 and 91 are mounted, as by welding, in cavities provided in the upper structural shapes 40 and 41 of the intermediate boom section or beam 19 to slide on diagonally situated plane bearing surfaces 92 and 93 in the upper structural shapes 30 and 31 of the inward or base boom section or beam 15, respectively.

As shown, each slide pad assembly 60, 61, 70, 71, 80, 81, 90 and 91 includes a container or pot 100 defined by a cylindrical outer surface 102 and a pair of mutually parallel end surfaces 104,104 situated at right angles to the axis of the cylindrical surface 102. Each container or pot 100 is welded into its associated side plate or upper structural shape to present a provided a rectilinear slide pad receptacle or chamber 106 in open facing relationship with respect to the associated plane sliding surface of the upper structural shape of the adjacent beam with respect to which the slide of the slide pad assembly is designed to move. Side walls 108 of each slide pad receptacle in each pot 100 are positioned in approximate right angular relationship to this plane sliding surface of the adjacent beam upper structural shape. A floor or bottom wall 110 of each such receptacle 106 is situated at right angles to the walls 108, in the form of the invention shown.

Figure 4:
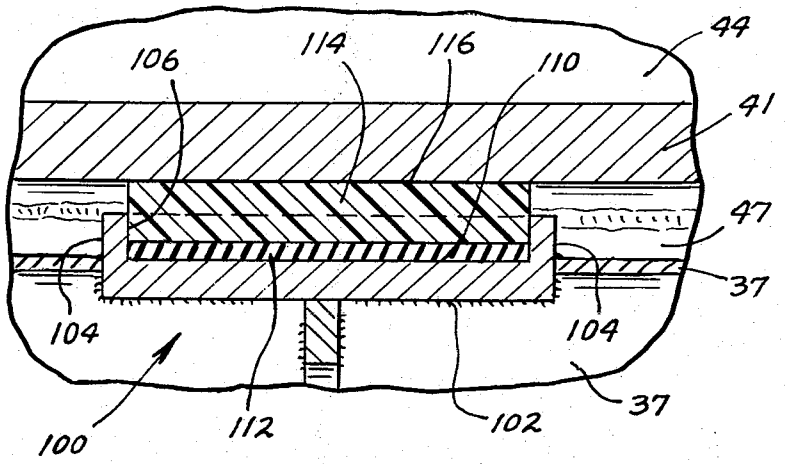
FIG. 4 is a further enlarged fragmentary sectional view taken on the line 4—4 in FIG. 3.
Figure 5:
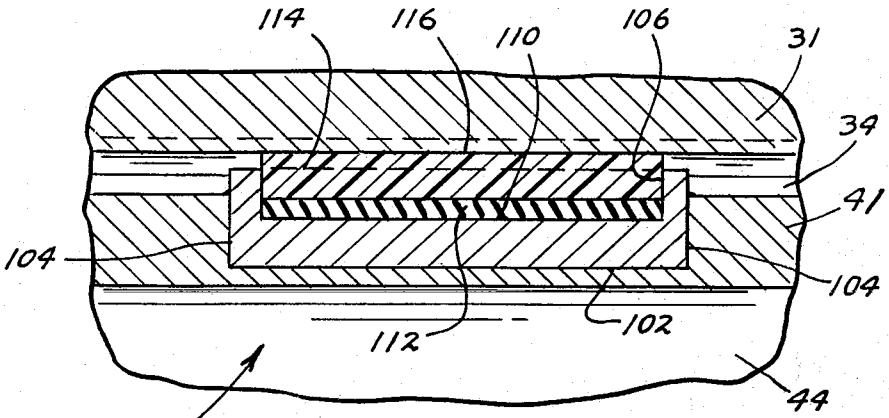
FIG. 5 is an enlarged substantially vertical sectional view taken on the line 5—5 in FIG. 1.
Figure 3:
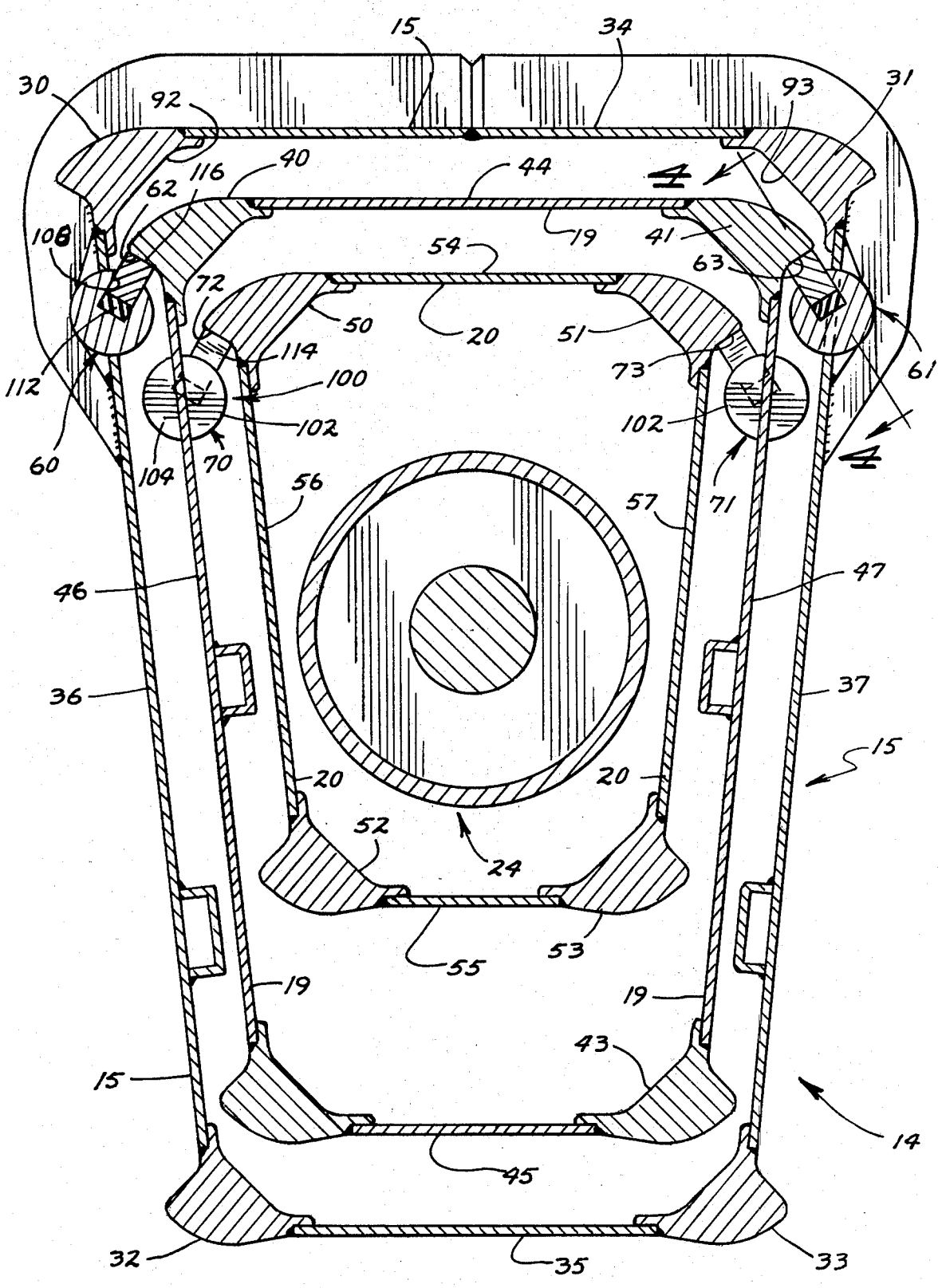
FIG. 3 is an enlarged vertical sectional view taken on the line 3—3 in FIG. 2 with parts omitted for clarity of illustration.
Figure 5:
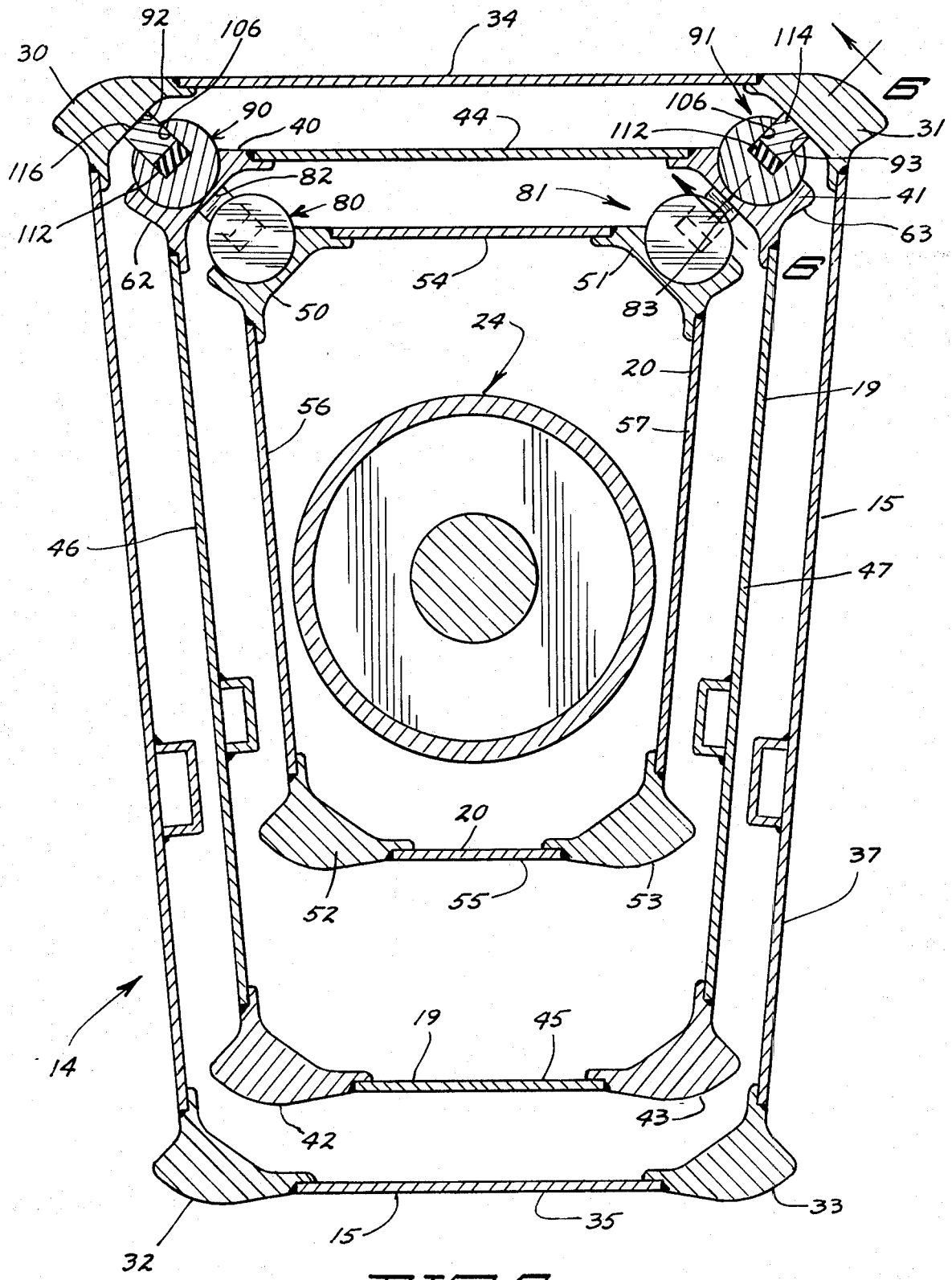

As best seen in FIGS. 3, 4, 5 and 6, the floor or bottom wall 110 of each pot receptacle 106 is covered with a soft free flowing elastic material 112 which extends up from the bottom along each side wall 108 for a distance substantially short of the top of that side wall. A wear pad or slide pad 114 of substantially exactly the same cross sectional dimension as that of the rectilinear slide pad receptacle 106 is situated on top of the soft free flowing elastic material 112 and extends substantially upwardly out of the pot 100 and into contact with the plane surface of the upper structural shape of the adjacent beam with respect to which it is to slide.

The soft, free flowing elastic material 112 can have the properties of neoprene rubber, for example; while the slide pads 114 can have the properties of urethane, nylon or some other suitable material that will wear away more readily than the structural shape surface on which it slides.

Specifically, a slide pad 114 of slide pad assembly 60 presents an upper wearing face 116 in parallel relationship to and to slide upon the plane bearing surface 62 of the upper structural shape 40. A similar upper wearing face 116 of the slide pad of forwardly mounted slide pad assembly 61 slides on plane bearing surface 63 or upper structural shape 41. Pad 114 of forwardly mounted slide pad assembly 70 slides on plane bearing surface 72 of upper structural shape 50. Pad 114 of slide pad assembly 71 slides on plane bearing surface 73 of structural shape 51. A slide pad 114 of rearwardly mounted slide pad assembly 80 slides on inwardly facing diagonally situated plane bearing surface 82 of upper structural shape 40. Pad 114 of slide pad assembly 81 slides on bearing surface 83 of structural shape 41. Pad 114 of rearwardly mounted slide pad assembly 90 slides on plane bearing surface 92 of upper structural shape 30 of base boom section 15. Pad 114 of slide pad assembly 91 slides on plane bearing surface 93 of structural shape 31.

A description of the operation and advantages of these slide pad assemblies with respect to their support of mutually telescoping beams which tend to deflect under load, and with respect to the ease of replacement of the slide pads of such assemblies, is set out in detail in our co-pending application for SELF-ALIGNING FLEXIBLE SLIDE PAD FOR TELESCOPING BEAMS, Ser. No. 948,773, filed Oct. 5, 1978; the full disclosure of which application is hereby incorporated into this application by this and a previous reference hereto, as are the listings and discussions of all of the prior art set out in that application.

OPERATION

As the sections or beams of the hydraulically extensible boom 14 are extended and retracted, the action of the slide pad 114 on the inwardly facing, diagonally situated, upwardly converging plane bearing surfaces of the inward beams and on the outer, diagonally situated, outwardly converging plane bearing surfaces of the outward beams is to provide the vertical component of support of the beams themselves and of any pay load or weight being handled at the boom point of the outward beam while at the same time keeping the beams in lateral alignment with each other by resisting any transverse forces on the beams caused by swinging of the boom and/or the load or otherwise.

The slide pads 114 are of softer material than that of the diagonally situated plane bearing surfaces of the various beams with which they are in sliding contact so that the wear necessarily occasioned by the inward and outward movement of the boom sections with respect to each other comes substantially entirely on these slide pads. In contrast to typical structures of the prior art, there is no necessity to laterally adjust side situated slide pads to overcome wear, as the beams will stay in alignment due to the angle of support of the slide pads on the diagonally situated plane bearing surfaces of the various upper structural members or shapes.

The slide pads can be allowed to wear down to positions very near the top of the pots 100 in which they are situated. When this point is reached, the boom sections will be disassembled one from the other, the slide pads 114 can be lifted out from their slide pads receptacles or chambers 106, and new slide pads inserted. The beams can then be reassembled with respect to each other.

From a theoretical standpoint, the most efficient design for a sliding boom section or beam would be to place all of the structural material in the four corners. The design of the beams of the present invention approaches this ideal situation by providing structural shapes in the four corners with thin plates or webs welded between them.

To suspend a boom section or beam in the front pad area of an inward beam, sufficient slide pad surface has been provided to effectively transmit the stress between the slide pad assembly on the inward beam and the contacted structural shape of the outward beam.

The deflection of the beams under load tends to cause an inward buckling of the top plates. Ideally the lines of force on the side plate, the top plate, and the pad reaction would all pass through the same point, thus creating zero rotation in the corners. In the structural shape used, the line of force of the pad reaction passes inside of this point, thus creating a slight upward moment in the corners. This upward moment overcomes the aforementioned tendency toward inward buckling of the top plate caused by boom deflection.

By mounting the slide pad assemblies 60, 61, 70 and 71 in upper portions of the base boom section 15 and intermediate boom section 19 respectively to bear on upper structural members 40, 41, 50 and 51, respectively, the forward portions of the slide plates 46, 47, 56, and 57 are under tension rather than being under compression as in the case of the typical structures of the prior art where the forwardly mounted slide pad assemblies are mounted in lower portions of the inward beams to bear on and slide with respect to lower portions of the outward beams.

However, many of the advantages of the invention could still be obtained if the forwardly mounted slide pad assemblies were mounted in lower forward portions of the inward boom sections, even though elimination of the tendencies toward compressive buckling would be lost.

The embodiments of the invention in which an exclusive property or privilege is claimed are defined as follows:

1. A telescopic boom assembly for supporting a load at an outward end thereof, said boom assembly being mounted to a base at an inward end thereof and including:

A. a plurality of mutually innernested, telescopically associated inward and outward boom sections;

B. each inward boom section being situated in surrounding, immediately adjacent relation to an outward boom section;

C. each such inward and outward boom sections being made up of:

(1) a pair of longitudinally extending, mutually parallel, spaced apart upper structural members of substantial strength and mass, (2) a relatively light top web integral with and extending between said upper structural members, (3) a pair of longitudinally extending, mutually parallel, spaced apart lower structural members of substantial strength and mass, (4) a relatively light bottom web integral with and extending between said lower structural members, and (5) a pair of relatively light, generally upright side webs each integral with a separate one of each of said upper and lower structural members;

D. forwardly mounted slide pad assemblies including slide pads on each inward boom section in position to slidingly support the upper structural members of an immediately adjacent outward boom section;

E. rearwardly mounted slide pad assemblies including slide pads on each outward boom section in position to be slidingly supported on the upper structural members of an immediately adjacent inward boom section;

F. means to move said boom sections longitudinally with respect to each other; and G. at least one of said forwardly mounted slide pad assemblies including:

(1) a pot having a cylindrical outer surface, said pot being provided with a rectilinear slide pad receptacle bounded by side walls opening through said cylindrical surface, and by a bottom wall in normal relationship to the side walls, each side wall being mutually parallel to a single radial line extending outwardly from the cylindrical axis of said pot;

(2) a soft, free flowing elastic material covering said bottom wall of each pot receptacle and terminating short of the top of the receptacle side walls; and (3) a slide pad of configuration to rest on said elastic material in said pot receptacle, to be in contacting relationship with all of said side walls and to terminate in a plane surface outside of said pot, said plane surface lying roughly parallel to the cylindrical axis of said pot; and H. said slide pad being made of a flexible material which wears more readily than the immediately adjacent outward boom section which it slidingly supports.

2. A telescopic boom assembly for supporting a load at an outward end thereof, said boom assembly being mounted to a base at an inward end thereof and including:

A. a plurality of mutually innernested, telescopically associated inward and outward boom sections;

B. each inward boom section being situated in surrounding, immediately adjacent relation to an outward boom section;

C. each such inward and outward boom sections being made up of:

(1) a pair of longitudinally extending, mutually parallel, spaced apart upper structural members of substantial strength and mass, (2) a relatively light top web integral with and extending between said upper structural members, (3) a pair of longitudinally extending, mutually parallel, spaced apart lower structural members of substantial strength and mass, (4) a relatively light bottom web integral with and extending between said lower structural members, and (5) a pair of relatively light, generally upright side webs each integral with a separate one of each of said upper and lower structural members;

D. forwardly mounted slide pad assemblies including slide pads on each inward boom section in position to slidingly support the upper structural members of an immmediately adjacent outward boom section;

E. rearwardly mounted slide pad assemblies including slide pads on each outward boom section in position to be slidingly supported on the upper structural members of an immediately adjacent inward boom section;

F. means to move said boom sections longitudinally with respect to each other; and G. at least one of said rearwardly mounted slide pad assemblies including:

(1) a pot having a cylindrical outer surface, said pot being provided with a rectilinear slide pad receptacle bounded by side walls opening through said cylindrical surface, and by a bottom wall in normal relationship to the side walls, each side wall being mutually parallel to a single radial line extending outwardly from the cylindrical axis of said pot;

(2) a soft, free flowing elastic material covering said bottom wall of each pot receptacle and terminating short of the top of the receptacle side walls; and (3) a slide pad of configuration to rest on said elastic material in said pot receptacle, to be in contacting relationship with all of said side walls and to terminate in a plane surface outside of said pot, said plane surface lying roughly parallel to the cylindrical axis of said pot; and H. said slide pad being made of a flexible material which wears more readily than the immediately adjacent outward boom section which it slidingly supports.

3. A telescopic boom assembly for supporting a load at an outward end thereof, said boom assembly being mounted to a base at an inward end thereof and including:

A. a plurality of mutually innernested, telescopically associated inward and outward boom sections;

B. each inward boom section being situated in surrounding, immediately adjacent relation to an outward boom section;

C. each such inward and outward boom sections being made up of:

(1) a pair of longitudinally extending, mutually parallel, spaced apart upper structural members of substantial strength and mass, (2) a relatively light top web integral with and extending between said upper structural members, (3) a pair of longitudinally extending, mutually parallel, spaced apart lower structural members of substantial strength and mass, (4) a relatively light bottom web integral with and extending between said lower structural members, and (5) a pair of relatively light, generally upright side webs each integral with a separate one of each of said upper and lower structural members;

D. forwardly mounted slide pad assemblies including slide pads on each inward boom section in position to slidingly support the upper structural members of an immediately adjacent outward boom section;

E. rearwardly mounted slide pad assemblies including slide pads on each outward boom section in position to be slidingly supported on the upper structural members of an immediately adjacent inward boom section;

F. means to move said boom sections longitudinally with respect to each other; and G. at least one of each of said forwardly mounted and rearwardly mounted slide pad assemblies including:

(1) a pot having a cylindrical outer surface, said pot being provided with a rectilinear slide pad receptacle bounded by side walls opening through said cylindrical surface, and by a bottom wall in normal relationship to the side walls, each side wall being mutually parallel to a single radial line extending outwardly from the cylindrical axis of said pot;

(2) a soft, free flowing elastic material covering said bottom wall of each pot receptacle and terminating short of the top of the receptacle side walls; and (3) a slide pad of configuration to rest on said elastic material in said pot receptacle, to be in contacting relationship with all of said side walls and to terminate in a plane surface outside of said pot, said plane surface lying roughly parallel to the cylindrical axis of said pot; and H. said slide pad being made of a flexible material which wears more readily than the immediately adjacent outward boom section which it slidingly supports.

4. A telescopic boom assembly for supporting a load at an outward end thereof, said boom assembly being mounted to a base at an inward end thereof and including:

A. a plurality of mutually innernested, telescopically associated inward and outward boom sections;

B. each inward boom section being situated in surrounding, immediately adjacent relation to an outward boom section;

C. each such inward and outward boom sections being made up of:

(1) a pair of longitudinally extending, mutually parallel, spaced apart upper structural members of substantial strength and mass, (2) a relatively light top web integral with and extending between said upper structural members, (3) a pair of longitudinally extending, mutually parallel, spaced apart lower structural members of substantial strength and mass, (4) a relatively light bottom web integral with and extending between said lower structural members, and (5) a pair of relatively light, generally upright side webs each integral with a separate one of each of said upper and lower structural members;

D. forwardly mounted slide pad assemblies including slide pads on each inward boom section in position to slidingly support the upper structural members of an immediately adjacent outward boom section;

E. rearwardly mounted slide pad assemblies including slide pads on each outward boom section in position to be slidingly supported on the upper structural members of an immediately adjacent inward boom section; and F. means to move said boom sections longitudinally with respect to each other.

5. The boom assembly of claim 1 wherein:

G. each of said inward and outward boom section upper structural members is of uniform cross sectional configuration over its entire innernestable slide pad contacting length and the cross sectional shape of each one of each pair of such structural members is a mirror image of the other of such pair; and H. each of said upper structural members of said outward boom sections are partially defined by an elongated outwardly and upwardly diverging plane bearing surface situated to be in weight bearing and sliding relation to one of said forwardly mounted slide pad assemblies.

6. The boom assembly of claim 5 wherein:

J. each of said forwardly mounted slide pad assemblies are mounted in one of the side webs of the immediately adjacent inward boom section to position its slide pad in sliding, load bearing relation to one of the upwardly diverging plane bearing surfaces of said upper structural members of said outward boom section.

7. The boom assembly of claim 5 wherein:

I. each of said upper structural members of said inward boom sections are partially defined by an elongated, inwardly and upwardly diverging plane bearing surface situated to be in weight bearing and sliding relation to one of said rearwardly mounted slide pad assemblies.

* * * * *